United States Patent [19]

Deal

[11] 4,452,012

[45] Jun. 5, 1984

[54] PIVOT SHOE FOR SASH BALANCE

[75] Inventor: Stephen M. Deal, Rochester, N.Y.

[73] Assignee: Caldwell Manufacturing Company, Rochester, N.Y.

[21] Appl. No.: 406,279

[22] Filed: Aug. 9, 1982

[51] Int. Cl.[3] ..... E05D 15/22

[52] U.S. Cl. ..... 49/181; 49/445

[58] Field of Search ..... 49/181, 445, 453

[56] References Cited

U.S. PATENT DOCUMENTS

| | | | |
|---|---|---|---|
| 1,097,524 | 5/1914 | Brownjohn . | |
| 1,832,058 | 11/1931 | Stewart . | |
| 1,873,066 | 8/1932 | Stewart . | |
| 2,361,551 | 10/1944 | Levyn . | |
| 3,012,292 | 12/1961 | Brengman | 49/181 X |
| 3,105,273 | 10/1963 | Nobes . | |
| 3,195,174 | 7/1965 | Nobes . | |
| 3,233,278 | 2/1966 | Lundgren . | |
| 3,482,354 | 12/1969 | Trout | 49/181 |
| 3,524,282 | 8/1970 | Kraft et al. . | |
| 3,611,636 | 10/1971 | Trout . | |
| 3,797,168 | 3/1974 | Trout . | |
| 3,844,066 | 10/1974 | Nobes . | |
| 4,227,345 | 10/1980 | Durham . | |
| 4,271,631 | 6/1981 | Trout . | |
| 4,290,231 | 9/1981 | Blair . | |
| 4,363,190 | 12/1982 | Anderson | 49/181 |

*Primary Examiner*—Kenneth Downey

*Attorney, Agent, or Firm*—Stonebraker, Shepard & Stephens

[57] ABSTRACT

A pivot shoe 10 has a bite spring 30 operated by a cam 40 for interlocking pivot shoe 10 with a jamb channel 15 to resist upward movement under the bias of a sash balance system when a sash 20 connected to a pivot shoe 10 by a pivot bar 22 is pivoted away from vertical. Pivot shoe 10 has a resin body 11 shaped to guide on the sides 16 of jamb channel 15 and cam 40 is pivotally housed within body 11 and slotted to receive pivot bar 22 so that cam 40 pivots with sash 20. The jamb end of cam 40 is profiled and bite spring 30 has a follower 32 engaging the cam profile 47. Bite spring 30 is mounted on the jamb side of pivot shoe 10 and upwardly inclined toward the jamb channel bottom 17. When sash 20 pivots from vertical, cam 40 tilts bite spring 30 outward so that its upper edge bites into channel bottom 17 and locks pivot shoe 10 against upward movement.

9 Claims, 9 Drawing Figures

PIVOT SHOE FOR SASH BALANCE

BACKGROUND

This invention improves on pivot shoes for double-hung windows that can pivot open as well as move vertically up and down. Pivot shoes for such windows are connected to the lower rails of each sash by pivot bars and move up and down in jamb channels aligned with the sash stiles. They also connect to the lower ends of sash balances that counterbalance each sash so that it will stay at any set position. The art has developed many such pivot shoes, all intended to serve similar functions that include interlocking with the jamb channel when the sash is pivoted open. Some pivot shoes use an interference grip with the jamb channel for this, and others have used biting edges or hooks.

Problems remain, however, especially with jamb channels of extruded resin that rare slipperier and more resilient than aluminum jamb channels. Also, heavier, double-glazed sash and correspondingly stronger sash balances place a greater locking load on pivot shoes. In addition, previous pivot shoes have suffered various malfunctions or disadvantages.

My improved pivot shoe uses a cam and bite spring arranged in a way that ensures stronger locking ability and greater compatibility with jamb channels made in different configurations of different materials. It is also economical to make and more reliable in operation.

SUMMARY OF THE INVENTION

My pivot shoes uses a bite spring and a cam mounted in a resin body shaped to guide on the sides of a jamb channel. The pivot shoe connects to a sash by a pivot bar and moves up and down in the jamb channel with the sash, and it also connects to a lower end of a sash balance and allows the sash to pivot. When this happens, the cam, which is slotted to receive the pivot bar, pivots within its housing and turns the profiled jamb end of the cam. A follower on the bite spring follows the cam profile for tilting the bite spring toward the channel bottom as the sash and cam pivot away from vertical. For this, the bite spring is mounted on the jamb side of the body below the cam and is upwardly inclined toward the bottom of the jamb channel above the cam. Resin projections on the body hold the bite spring in place and resiliently retract it away from the channel bottom when the sash and cam pivot back to vertical. A biting edge on the upper edge of the bite spring bites into the channel bottom when tilted against the channel bottom by the cam and follower for resisting upward movement of the pivot shoe in the jamb channel from the bias of the sash balance. The cam is preferably trapped against axial movement within its housing in the body, and the cam profile is preferably a notch shape with a follower on the bite spring having a corresponding U shape that rests in the notch and can move up a side of the notch when the sash and cam pivot for vertical.

DRAWINGS

DETAILED DESCRIPTION

Figure 1:
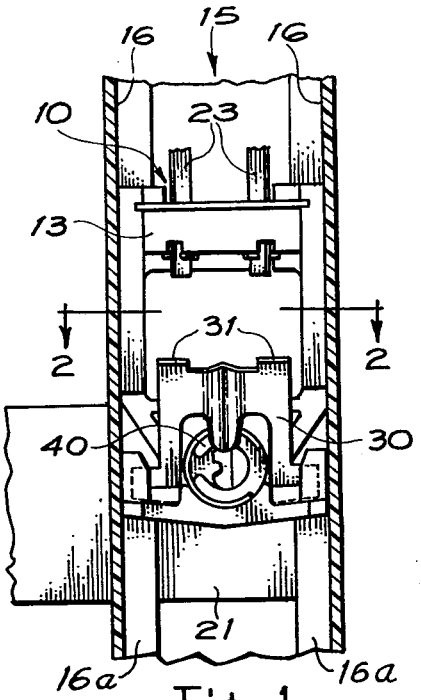
FIG. 1 is a fragmentary view of a preferred embodiment of my pivot shoe connected to a window sash and locked in a jamb channel, the bottom of which is cut away to reveal an elevation of the jamb side of the pivot shoe.
Figure 3:
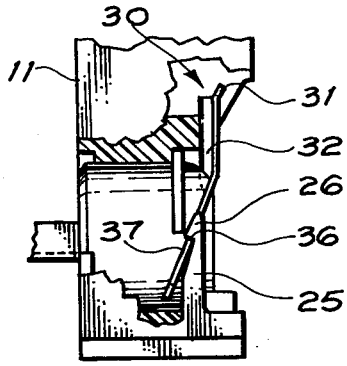
FIGS. 3 and 4 are fragmentary side elevational views of the pivot shoe of FIGS. 1 and 2 partly cut away to show respectively unlocked and locked positions.
Figure 2:
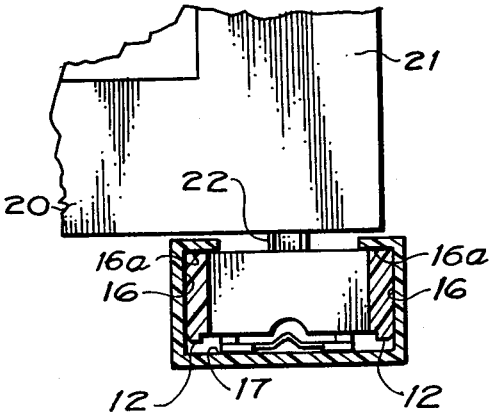
FIG. 2 is a fragmentary cross-sectional view of the pivot shoe, jamb channel, and window sash of FIG. 1, taken along the line 2—2 thereof.
Figure 4:
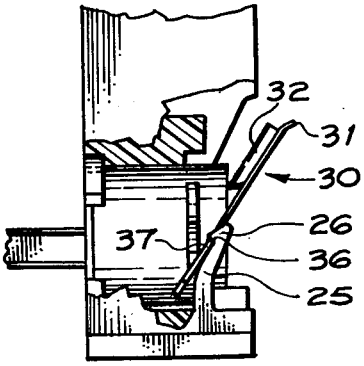
Figure 8:
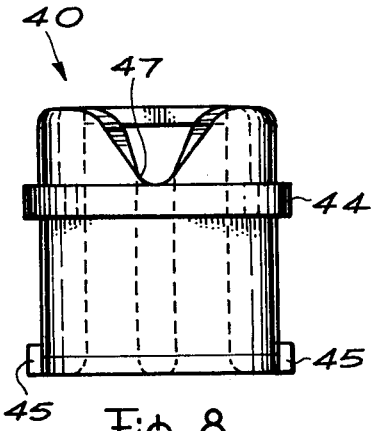
FIGS. 5–8 are respectively a side elevation, a sash end elevation, a jamb end elevation, and a plan view of the cam housed in the pivot shoe.
Figure 9:
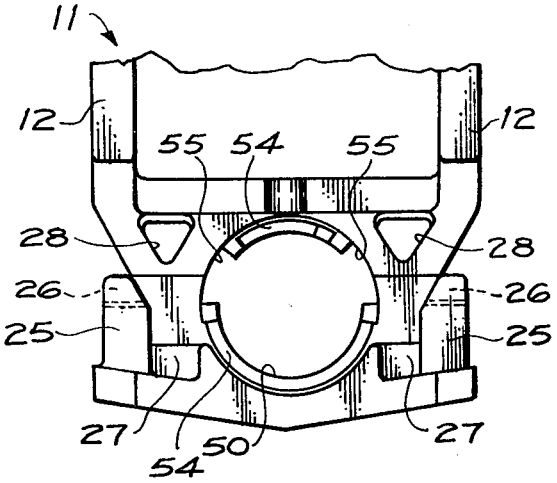
FIG. 9 is a fragmentary elevational view of the jamb side of the lower region of the pivot shoe with the cam and bite spring removed.
Figure 6:
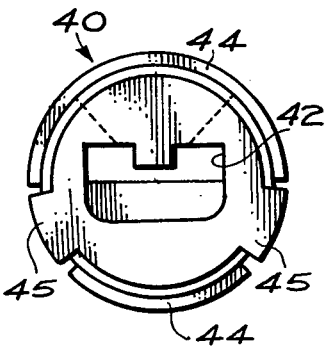
Figure 5:
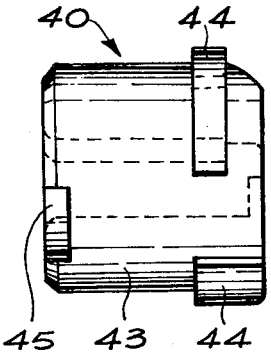
Figure 7:
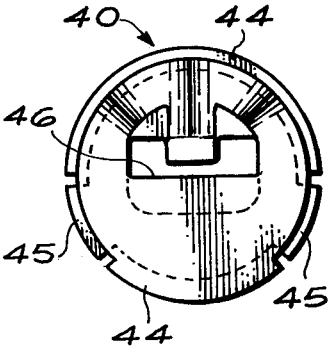

Pivot shoe 10 operates in an environment that is well understood and only partially illustrated in the drawings. This includes a vertical jamb channel 15 with sides 16 and a bottom 17 in which pivot shoe 10 moves vertically by guiding on channel sides 16. It also includes a sash 20 of the double-hung type that can move up and down along jamb channel 15 and can also pivot from its normal vertical position to a horizontal position such as shown in FIGS. 1 and 2. Pivot shoe 10 connects to lower sash rail 21 by a pivot bar 22 and to the lower end of a sash balance 23 for counteracting the weight of sash 20. Sash balance 23 is typically a spring tensioned device extending vertically in jamb channel 15, and the lower end of sash balance 23 connects to an upper torsion region 13 of pivot shoe 10.

Pivot shoe 10 guides up and down the sides 16 of jamb channel 15 as sash 20 is raised and lowered, and it affords a coupling between sash balances 23 and sash 20 so that the weight of the sash is balanced and will stay in any set position. Sash 20 is also arranged to pivot open, and as sash 20 pivots away from vertical, it rotates pivot bar 22 to cause pivot shoe 10 to lock in place within channel 15. Otherwise, pivoting sash 20 to a horizontally open position lightens the downward load on sash balances 23, which would tend to raise the sash upward. Automatic locking of pivot shoes 10 in jamb channel 15 when sash 20 is pivoted open prevents this.

A typical window suitable for using the inventive pivot shoe 10 includes two sashes, four jamb channels, four pivot shoes, and possibly eight sash balances. Details of the components other than pivot shoe 10 are generally known in the art and so are not illustrated or described here. My pivot shoe 10 combines several elements that interact to make it automatic locking simple, positive, and reliable and otherwise make the pivot shoe economical to construct, versatile in fitting different sorts of jamb channels, and foolproof in operation.

Instead of a frictional interference that is commonly the locking mechanism for pivot shoes, my pivot shoe locks with a bite spring 30 operated by a cam 40. Bite spring 30 is mounted in a lower region of the jamb side of pivot shoe 10 and is inclined upwardly above cam 40 to an upper edge 31 disposed adjacent to bottom 17 of jamb channel 15 and angled to bite into channel bottom 17. When cam 40 tilts bite spring 30 toward channel bottom 17, this biting occurs and is oriented to resist the upward pull of sash balances 23 so that pivot shoe 10 automatically locks within channel 15 against upward movement. Pivot shoe 10 can also be locked in a jamb channel in a similar way during factory assembly of a window.

Bite spring 30 is especially effective in resin jamb channels that are typically more resilient than aluminum ones. The outward tilting of bite spring 30 gives biting edge 31 sufficient travel to accommodate manufacturing tolerances in different jamb channel depths. Also, bite spring 30 itself is resilient so that it is resiliently sprung against channel bottom 17 so as to bite reliably in a range of channel depths.

I have found that bite spring 30 biting against channel bottom 17 is a more effective locking mechanism than an edge biting against channel sides 16, which are typically more resilient and can be sprung apart. I have also found that my pivot shoe 10 glides up and down more effectively in channel 15 by guiding on the channel return legs 16a and the outer edges of the channel bottom 17, leaving the center of the channel bottom 17 available for a biting interlock. Then if the center of the channel bottom 17 becomes lightly scored from locking bites by edge 31, this does not roughen the guiding surface or affect the smoothness and ease of raising and lowering a sash.

Cam 40 has a slot 42 that receives pivot bar 22 extending from lower rail 21 of sash 20. Pivoting of sash 20 is transmitted via pivot bar 22 to cam 40 so that cam 40 pivots with sash 20.

Pivot shoe 10, which preferably has its body 11 formed of molded resin, accommodates pivoting of cam 40 by providing a cylindrical housing 50 in which the cylindrical body 43 of cam 40 can turn. An interrupted collar 44 near the jamb end of cam 40 bears against an interrupted ledge 54 formed in housing 50, and cam 40 is inserted into housing 50 from the jamb side of pivot shoe 10 so that collar 44 engages ledge 54 and determines the axial operating position of cam 40.

Collar keys 45 on cam 40 fit through key ways 55 in housing 50 and, when rotated to an operating orientation, prevent retraction of cam 40 axially toward the jamb side of pivot shoe 10. Movement in this direction is also prevented by a follower on bite spring 30 as explained below. Cam 40 also has an abutment 46 that limits the depth of penetration of pivot bar 22 into cam 40.

The jamb end of cam 40 has a notch-shaped profile 47 that tilts bite spring 30 toward and away from channel bottom 17 for operation. Bite spring 30 has a follower 32 that is preferably U-shaped to fit notch profile 47 of cam 40. When sash 20 is vertical during normal operation, follower 32 rests in the bottom of notch 47 so that bite spring 30 is not pressed into channel bottom 17 and sash 20 is free to move up and down. As sash 20 pivots away from vertical, cam 40 rotates, forcing follower 32 axially of cam 40 up one of the sides of notch 47. This tilts bite bar 30 toward channel bottom 17 for a biting interlock. Making notch profile 47 and follower 32 symmetrical as illustrated is preferred so that each pivot shoe 10 can be arranged in either the right or left jamb channel for either right hand or left hand operation.

Projections 25 standing generally upright from a lower region of resin body 11 have hooks 26 that engage upward facing edges 36 of bite spring 30 to hold it against upward movement. This also allows bite spring 30 to be pressed downward over hooks 26 and automatically locked in an assembled position when hooks 26 snap over edges 36.

Projections 25 are resilient and serve as retractor springs for pulling bite spring 30 and its biting edge 31 away from channel bottom 17 whenever sash 20 is pivoted back to its vertical position. Projections 25 thus bias follower 32 against cam profile 47 so that bite spring 30 retracts from a biting interlock whenever cam 40 permits.

A surface 27 on body 11 extending around the underside of housing 50 as a guide for cam 40 fits between downwardly extending legs 37 of bite springs 30 and prevents any sideways movement of bite spring 30. Openings 28 in body 11 above guiding surface 27 provide attachment points for any necessary shim on the sash side of pivot shoe 10.

Body 11 preferably has ridges 12 along the side edges engaging channel bottom 17 adjacent channel sides 16. Ridges 12 straddle a region of channel bottom 17 that is engaged by the pair of biters formed by interrupted biting edge 31. Except for possible bites by edge 31, this region of channel bottom 17 is not otherwise engaged by body 11 of pivot shoe 10. This ensures that any roughening of channel bottom 17 from repeated bites by edge 31 does not impair the free sliding motion of sliding shoe 10 in channel 15.

The preferred configurations of the illustrated pivot shoe 10 with its cam 40 and bite spring 30 are shaped so that body 11 and cam 40 can be molded and bite spring 30 can be made as a simple stamped or molded part. The configuration of these components also insures that everything stays in its proper place during operation. Cam 40 is trapped within housing 50 in body 11 and cannot cause a mishap by moving axially, bite spring 30 is locked against both vertical and lateral movement, and the profile 47 of cam 40 and the resilience of bite spring 30 insure a reliable biting interlock with channel bottom 17 within a practical range of channel size tolerances.

I claim:

1. A pivot shoe connectable to a sash by a pivot bar and movable up and down in a jamb channel with said sash for connecting to a lower end of a sash balance and allowing said sash to pivot, said pivot shoe comprising:

a. a resin body shaped to guide on the sides of said jamb channel;

b. a cam pivotally housed within said body and slotted to receive said pivot bar;

c. a jamb end of said cam being profiled;

d. a bite spring mounted on a jamb side of said body below said cam and upwardly inclined toward the bottom of said jamb channel above said cam;

e. a follower cam on said bite spring arranged for following said profiled end of said cam to tilt said bite spring toward said channel bottom as said sash and said cam pivot away from vertical;

f. resin projections on said body arranged for holding said bite spring in place and resiliently retracting said bite spring away from said channel bottom when said sash and said cam pivot back to vertical; and g. a biting edge on an upper edge of said bite spring arranged for biting into said channel bottom when tilted against said channel bottom by said cam and follower for resisting upward movement of said pivot shoe in said jamb channel from the bias of said sash balance.

2. The pivot shoe of claim 1 including ridges along side edges of said body engaging said channel bottom adjacent said channel sides and straddling a region of said channel bottom engaged by said biting edge.

3. The pivot shoe of claim 1 wherein said resilient projections have hooks that interlock with upwardly facing edges in a lower region of said bite spring to hold said bite spring against upward movement relative to said body.

4. The pivot shoe of claim 1 wherein said profiled end of said cam has a notch shape and said follower has a U shape resting in said notch shape when said sash and said cam are vertical and moving up a side of said notch shape when said sash and said cam pivot from vertical.

5. The pivot shoe of claim 1 wherein said cam is held against movement toward said sash by a collar on said jamb end arranged to prevent said cam from passing through said body toward said sash.

6. The pivot shoe of claim 5 wherein said cam is held against movement away from said sash by the engagement of said follower with said profiled end and by a collar key on said cam arranged to slide through a key way to the sash side of said body and prevent movement of said cam away from said sash in pivotally operable positions of said cam.

7. The pivot shoe of claim 6 wherein said profiled end of said cam has a notch shape and said follower has a U shape resting in said notch shape when said sash and said cam are vertical and moving up a side of said notch shape when said sash and said cam pivot from vertical.

8. The pivot shoe of claim 7 wherein said resilient projections have hooks that interlock with upwardly facing edges in a lower region of said bite spring to hold said bite spring against upward movement relative to said body.

9. The pivot shoe of claim 8 including ridges along side edges of said body engaging said channel bottom adjacent said channel sides and straddling a region of said channel bottom engaged by said biting edge.

* * * * *